US011135634B2

(12) United States Patent
Miyake et al.

(10) Patent No.: US 11,135,634 B2
(45) Date of Patent: Oct. 5, 2021

(54) PRESS FORMING DEVICE AND METHOD FOR PRODUCING PRESS-FORMED ARTICLES

(71) Applicant: JFE Steel Corporation, Tokyo (JP)

(72) Inventors: Hiroto Miyake, Tokyo (JP); Toyohisa Shinmiya, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 92 days.

(21) Appl. No.: 16/497,643

(22) PCT Filed: Mar. 19, 2018

(86) PCT No.: PCT/JP2018/010829
§ 371 (c)(1),
(2) Date: Sep. 25, 2019

(87) PCT Pub. No.: WO2018/180712
PCT Pub. Date: Oct. 4, 2018

(65) Prior Publication Data

US 2020/0101509 A1 Apr. 2, 2020

(30) Foreign Application Priority Data

Mar. 28, 2017 (JP) ..... JP2017-062450

(51) Int. Cl.
*B21D 22/26* (2006.01)
*B21D 24/02* (2006.01)
(Continued)

(52) U.S. Cl.
CPC ..... *B21D 22/26* (2013.01); *B21D 22/06* (2013.01); *B21D 22/21* (2013.01); *B21D 24/02* (2013.01); *B21D 5/01* (2013.01); *B21D 37/08* (2013.01)

(58) Field of Classification Search
CPC ..... B21D 22/02; B21D 22/06; B21D 22/21; B21D 22/26; B21D 22/30; B21D 24/02;
(Continued)

(56) References Cited

U.S. PATENT DOCUMENTS 5,211,047 A * 5/1993 Kaneyuki ..... B21D 11/10 72/313
10,220,427 B2 3/2019 Yoshikawa et al.
(Continued)

FOREIGN PATENT DOCUMENTS

CN 202180145 U 4/2012
CN 202893911 U 4/2013
(Continued)

OTHER PUBLICATIONS

International Preliminary Report on Patentability and Written Opinion for International Application No. PCT/JP2018/010829, dated Oct. 1, 2019, 8 pages.
(Continued)

*Primary Examiner* — Adam J Eiseman
*Assistant Examiner* — Matthew Stephens
(74) *Attorney, Agent, or Firm* — RatnerPrestia

(57) ABSTRACT

To reduce warping of vertical wall portions without causing buckling occurring in a component shape not having a flange portion. A punch and a pad sandwiching a top sheet portion therebetween in the sheet thickness direction, bending blades for bend-forming the vertical wall portions, and stoppers facing the bending blades in the press direction and constraining end portions of a material to be machined are provided. The punch is supported by a first cushion component elastically expandable and contractible in the press direction. The bending blades each have an upper die component and a lower die component disposed facing each other in the press direction with an interval (D) equal to or
(Continued)

larger than a set compression amount and a second cushion component interposed between the upper die component and the lower die component, maintaining the interval (D), and contractible in the press direction at a predetermined pressure or more. The cushion pressure of the second cushion component is lower than the cushion pressure of the first cushion component and has such cushion pressure that the second cushion component does not contract during the bend-forming of the vertical wall portions.

3 Claims, 6 Drawing Sheets

(51) Int. Cl.

| | |
|---|---|
| ***B21D 22/06*** | (2006.01) |
| ***B21D 22/21*** | (2006.01) |
| ***B21D 5/01*** | (2006.01) |
| ***B21D 37/08*** | (2006.01) |

(58) Field of Classification Search
CPC .. B21D 37/08; B21D 5/01; B21D 5/06; B30B 15/061
USPC ..... 72/470
See application file for complete search history.

(56) References Cited

U.S. PATENT DOCUMENTS

| | | | | |
|---|---|---|---|---|
| 2007/0125149 | A1* | 6/2007 | Yoshitome | B21D 22/02 72/356 |
| 2013/0040161 | A1* | 2/2013 | Gerlach | B21K 1/30 428/603 |
| 2014/0000336 | A1 | 1/2014 | Alm | |
| 2016/0263637 | A1* | 9/2016 | Yoshikawa | B21J 13/025 72/356 |
| 2017/0182539 | A1* | 6/2017 | Makabe | B21D 24/14 72/356 |
| 2018/0264534 | A1* | 9/2018 | Aso | B21D 22/30 72/356 |
| 2019/0022729 | A1* | 1/2019 | Suzuki | B21D 24/04 72/356 |

FOREIGN PATENT DOCUMENTS

| | | | | |
|---|---|---|---|---|
| CN | 204052626 | U | 12/2014 | |
| CN | 105792960 | A | 7/2016 | |
| DE | 19853130 | A1 * | 5/2000 | B21D 22/26 |
| JP | 59220227 | A | 12/1984 | |
| JP | 04284921 | A | 10/1992 | |
| JP | 2003290833 | A | 10/2003 | |
| JP | 3856094 | B2 * | 12/2006 | B21D 5/01 |
| JP | 3856094 | B2 | 12/2006 | |
| JP | 2010099700 | A | 5/2010 | |
| JP | 4879588 | B2 | 2/2012 | |
| JP | 5444687 | B2 | 3/2014 | |
| JP | 2018164919 | A | 10/2018 | |
| WO | 2012128707 | A1 | 9/2012 | |
| WO | 2015083812 | A1 | 6/2015 | |

OTHER PUBLICATIONS

Chinese Office Action with Search Report for Chinese Application No. 201880019877.1, dated Jun. 9, 2020, 13 pages.
International Search Report and Written Opinion for International Application No. PCT/JP2018/010829, dated Jun. 19, 2018—5 pages.

* cited by examiner

PRESS FORMING DEVICE AND METHOD FOR PRODUCING PRESS-FORMED ARTICLES

CROSS REFERENCE TO RELATED APPLICATIONS

This is the U.S. National Phase application of PCT/JP2018/010829, filed Mar. 19, 2018, which claims priority to Japanese Patent Application No. 2017-062450, filed Mar. 28, 2017, the disclosures of each of these applications being incorporated herein by reference in their entireties for all purposes.

FIELD OF THE INVENTION

The present invention relates to a press forming device press-forming abase sheet or a material to be processed (blank) obtained by applying bending or drawing to a base sheet beforehand into a hat cross-sectional shape not having a flange portion and a technology of producing a press-formed article of a hat cross-sectional shape not having a flange portion.

BACKGROUND OF THE INVENTION

When a metal sheet (base sheet) is press-formed into a hat cross-sectional shape having a top sheet portion and right and left vertical wall portions continuous thereto as typified by a lower member which is a constituent component of a vehicle front impact-absorbing member, springback deformation due to elastic recovery occurs in a press-formed article after forming release, so that product dimensional accuracy resulting from the springback deformation poses a problem in some cases. Particularly in a recent automobile frame component, the use of thin high-tensile steel sheets for the constituent component has increased in order to simultaneously achieve both a body weight reduction and collision safety. However, when a metal sheet containing such materials is simply press-formed, the springback is large, so that poor dimensional accuracy becomes obvious.

The poor dimensional accuracy problem becomes obvious particularly when performing press-forming into a component in which at least one of vertical wall portions is curved as viewed from above as illustrated in FIG. 1. The poor dimensional accuracy due to a springback phenomenon described above includes not only two-dimensional poor dimensional accuracy due to collapse of the cross-sectional shape but three-dimensional poor dimensional accuracy, such as warping in the component longitudinal direction or the twist of the entire component. A large number of countermeasure technologies against each poor phenomenon have been proposed.

Herein, the collapse of the cross-sectional shape occurs due to a phenomenon in which the elasticity is recovered in a direction where the cross section of the pressed component is opened mainly due to an angle change in a bent portion which is a boundary portion between the top sheet portion and the vertical wall portions and the warping of the vertical wall portions.

Furthermore, when a component in which at least one of the vertical wall portions is curved in the longitudinal direction is produced, the springback deformation occurs in a waving shape in the vertical wall portions due to a difference in the warping degree of the vertical wall portion in each cross section in the longitudinal direction. Therefore, the waving of the vertical wall portions generated by the deformation poses a problem. The waving of the vertical wall portions is difficult to improve in expectation for a die shape. Therefore, a press-forming technology of reducing the warping itself of the vertical wall in each cross section is required.

As a countermeasure technology against the warping of the vertical wall portion, a forming technology of reducing a stress difference between the front and rear sides in the sheet thickness direction which is a principal factor of the warping has been conventionally considered.

For example, PTL 1 has proposed a technology of forming an intermediate component, which has been formed so as to be higher or lower by several millimeters than the vertical wall height of a product shape in a proceeding process, so as to have a vertical wall height of the product shape in the final process to thereby generate tensile or compression stress in the entire vertical wall to suppress vertical wall warping.

PTL 2 has proposed a technology of pressing a blank with an upper die and a lower die, and then applying compression stress to a component vertical wall portion in a state where the flange end is constrained by the elevation of a holder provided with a structure constraining end portions.

PTL 3 discloses a structure having a pair of die structures having an upper die and a lower die performing die clamping, in which a pad is provided on the undersurface side of the upper die and the lower die has a cushion. A technology has been proposed in which the upper die and the pad have a structure in which connection portions having irregular shapes are engaged with each other in order to prevent buckling of a vertical wall portion and compression stress is applied to the vertical wall portion in a state where blank end portions are constrained by the structure. In PTL 3, the compression amount between the upper die and the pad is adjusted based on the thickness of a shim inserted in a spacer insertion portion (Paragraphs 0035 and 0045).

PATENT LITERATURE

PTL 1: JP 4879588 B
PTL 2: JP 5444687 B
PTL 3: JP 3856094 B

SUMMARY OF THE INVENTION

However, PTLs 1 and 2 assume a forming technology of a hat cross-sectional component having a flange portion, and thus are difficult to be applied to a hat cross-sectional component not having a flange portion, such as a lower member. Furthermore, PTLs 1 and 2 described above do not take effective countermeasures against the blank buckling which poses a problem in applying the compression stress to the component vertical wall portion, and therefore the compression amount which can be applied is limited.

PTL 3 has a mechanism of preventing the blank from buckling during compression by giving the irregular shapes to the connection portions of the upper die and the pad. However, according to the forming technology, not only the die structure becomes complicated but there is a risk that the die is greatly damaged when forming is performed in a state where the irregular shapes are not successfully engaged with each other, and therefore it is considered that the application to mass production is difficult. Moreover, the compression amount is also adjusted based on the thickness of the shim, and therefore the adjustment becomes correspondingly complicated.

The present invention has been made focusing on the above-described problems. It is an object of the present invention to provide a press forming device capable of reducing warping of a vertical wall portion occurring in a component shape not having a flange portion without causing buckling when performing press-forming into a press-formed article of a hat cross-sectional shape not having a flange portion and a method for producing a press-formed article.

The present inventors have extensively examined the warping of a curved vertical wall portion caused by springback. As a result, the present inventors have obtained knowledge that, by applying compression stress to the vertical wall portion in a state where blank end portions are constrained with stoppers and out-of-plane deformation of the blank end portions is constrained with a bending blade and a punch, the stress difference between the rear and front sides in the sheet thickness direction generated before the application of the compression decreases, so that the vertical wall warping can be reduced.

The present invention has been made based on such knowledge.

In order to solve the problems, a press forming device of one aspect of the present invention is a press forming device for performing a first process of bend-forming a base sheet or a material to be processed obtained by applying bending or drawing to a base sheet beforehand into a hat cross-sectional shape having a top sheet portion and right and left vertical wall portions continuous to both sides in the width direction of the top sheet portion and not having a flange portion and a second process of applying compression by a preset compression amount in a direction along the press direction to the vertical wall portions in the formed state by the first process, and the press forming device is provided with a punch and a pad sandwiching the top sheet portion therebetween in the sheet thickness direction, bending blades disposed on the sides of the punch and the pad and bend-forming the vertical wall portions, and stoppers facing the bending blades in the press direction and constraining end portions of the material to be processed, in which the pad and the bending blades configure an upper die, the punch is supported by a first cushion component elastically expandable and contractible in the press direction, the bending blades each have an upper die component and a lower die component which are vertically divided in the middle of the press direction and disposed facing each other in the press direction with an interval equal to or larger than the compression amount to be applied and a second cushion component interposed between the upper die component and the lower die component, maintaining the interval, and contractible in the press direction at a predetermined pressure or more, and the cushion pressure of the second cushion component is lower than the cushion pressure of the first cushion component and has such cushion pressure that the second cushion component does not contract during the bend-forming of the vertical wall portions in the first process.

A method for producing a press-formed article of one aspect of the present invention includes a first process of forming a base sheet or a material to be processed obtained by applying bending or drawing to a base sheet beforehand into a hat cross-sectional shape having a top sheet portion and right and left vertical wall portions continuous to both sides in the width direction of the top sheet portion and not having a flange portion and a second process of applying compression by a preset compression amount in a direction along the press direction to the vertical wall portions in the formed state by the first process, in which, using a die which is provided with a punch and a pad sandwiching the top sheet portion therebetween in the sheet thickness direction, bending blades disposed on the sides of the punch and the pad and bend-forming the vertical wall portions, and stoppers facing the bending blades in the press direction and constraining end portions of the material to be processed and in which the pad and the bending blades configure an upper die and the bending blades each have an upper die component and a lower die component vertically divided in the middle of the press direction and disposed facing each other in the press direction with an interval equal to or larger than the compression amount to be applied and a cushion component interposed between the upper die component and the lower die component, maintaining the interval, and contractible in the press direction at a predetermined pressure or more, in the first process, the vertical wall portions are bend-formed by moving the bending blades in the press direction while maintaining a state where the cushion component does not contract by cushion pressure until the end portions of the material to be processed abut on the stoppers and the lower die components abut on the stoppers while sandwiching the top sheet portion with the punch and the pad and in the second process, the bending blades are further moved in the press direction by the preset compression amount following the first process, so that the vertical wall portions are sandwiched between the bending blades and the side surface of the punch, whereby the interval becomes small while preventing buckling, so that the compression is applied to the vertical wall portions.

One aspect of the present invention can provide a press-formed article having good dimensional accuracy by reducing the warping of vertical wall portions occurring when performing press-forming into a component shape having the top sheet portion and the vertical wall portions continuous thereto and not having a flange portion.

BRIEF DESCRIPTION OF DRAWINGS

FIGS. 2A and 2B are figures explaining a press-formed article according to an embodiment based on the present invention, in which FIG. 2A is an perspective view and FIG. 2B is a figure viewed from above;

DETAILED DESCRIPTION OF EMBODIMENTS OF THE INVENTION

Next, an embodiment of the present invention will now be described with reference to the drawings.

Figure 1:
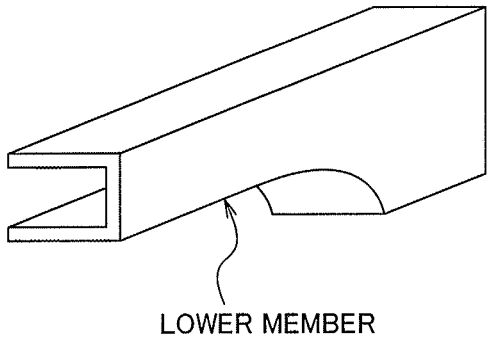
FIG. 1 is a perspective view illustrating an example of a component which has a hat cross-sectional shape not having a flange portion and in which at least one of vertical wall portions is curved among body frame components.
Figure 2A:
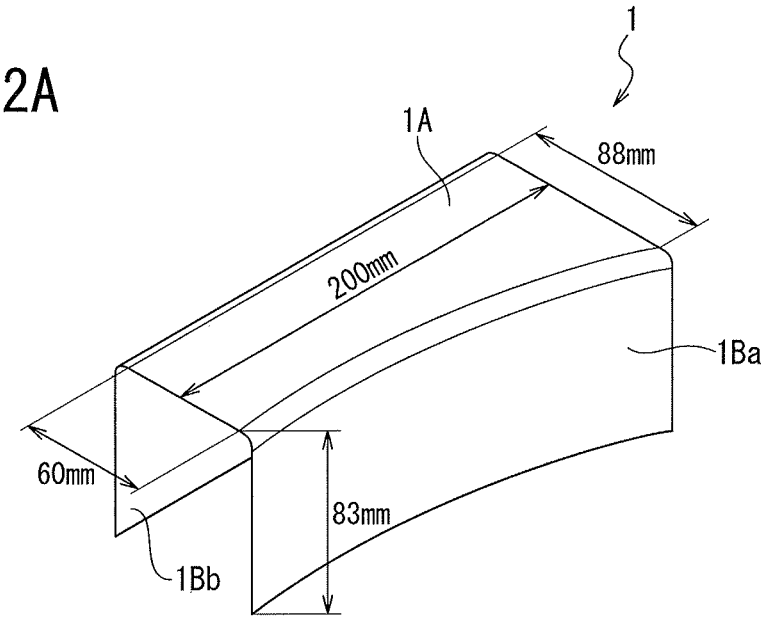
Figure 2B:
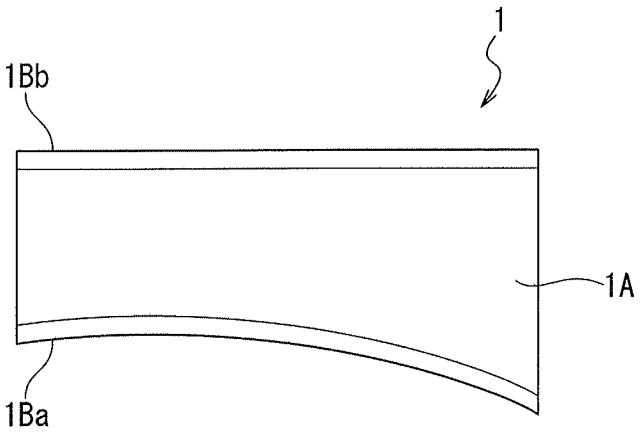

Herein, the following description is directed to a hat cross-sectional shape having a top sheet portion 1A and right and left vertical wall portions 1Ba, 1Bb continuous to both sides in the width direction of the top sheet portion 1A and not having a flange portion as illustrated in FIGS. 2A and 2B as the shape of a press-formed article 1. In this embodiment, the description is given taking a case where one vertical wall portion 1Bb is linear and the other vertical wall portion 1Ba is curved along the longitudinal direction in a view from above as an example. However, the shape of the press-formed article 1 targeted by the present invention is not limited to the shape as illustrated in FIGS. 2A and 2B. The present invention in an embodiment is applicable insofar as the shape of the press-formed article 1 is a hat cross-sectional shape having the top sheet portion 1A and the right and left vertical wall portions 1Ba, 1Bb continuous to both sides in the width direction of the top sheet portion 1A and not having a flange portion. The present invention in an embodiment is more effective in a case where at least one of the vertical wall portions 1Ba, 1Bb is curved along the longitudinal direction. The dimensions illustrated in FIGS. 2A and 2B are examples and the dimensions in Examples are also indicated. The angle formed by the top sheet portion 1A and the vertical wall portion 1Ba, 1Bb is set to 90° or more and 100° or less, for example.

The present invention in an embodiment particularly exhibits the effects when a material to be processed 2 is a metal sheet having tensile strength of 440 MPa or more and preferably 590 MPa or more.

<Die>

Figure 3:
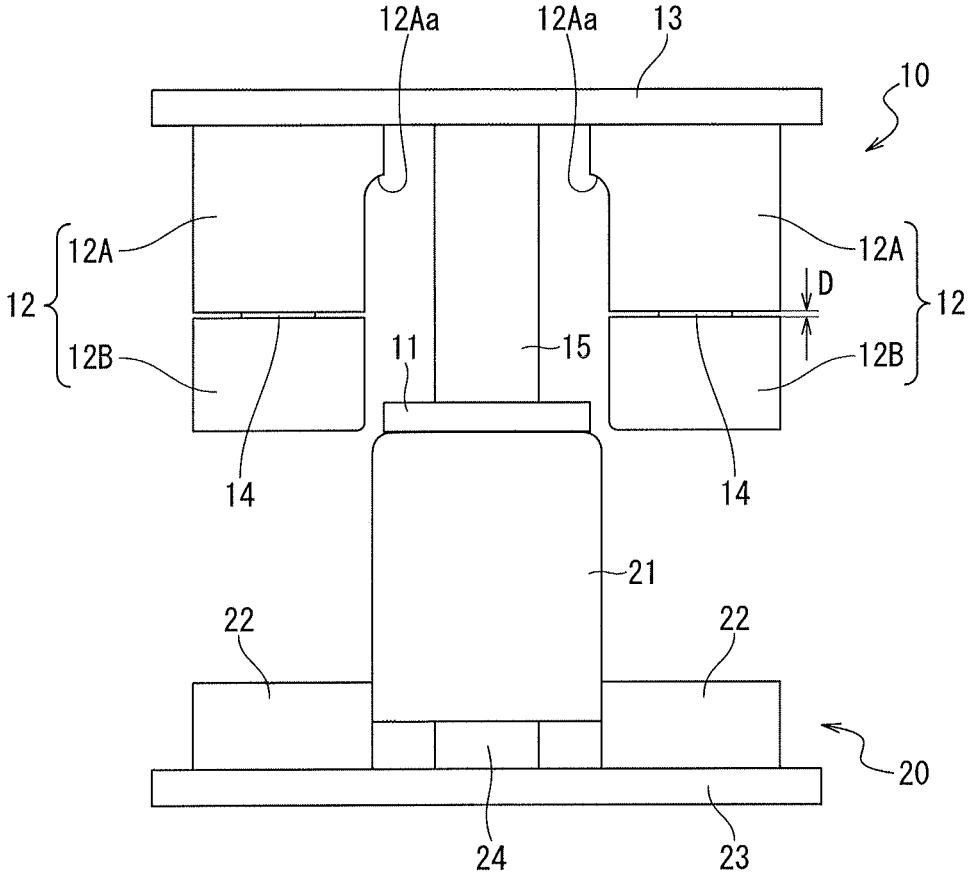
FIG. 3 is a schematic cross-sectional view explaining a die according to the embodiment based on the present invention.

A press forming device of this embodiment is provided with a punch 21 and a pad 11 sandwiching the top sheet portion 1A therebetween in the sheet thickness direction, bending blades 12 disposed on the sides of the punch 21 and the pad 11 and bend-forming the vertical wall portions 1Ba, 1Bb, and stoppers 22 facing the bending blades 12 in the press direction and constraining end portions of the material to be processed 2 (see FIG. 3). The punch 21 is supported by a first cushion component 24 elastically expandable and contractible in the press direction. The bending blades 12 each have an upper die component 12A and a lower die component 12B vertically divided in the middle of the press direction and disposed facing each other in the press direction with an interval D equal to or larger than the compression amount to be applied and a second cushion component 14 interposed between the upper die component 12A and the lower die component 12B, maintaining the interval D, and contractible in the press direction at predetermined pressure or more. The cushion pressure of the second cushion component 14 is lower than the cushion pressure of the first cushion component 24 and has such cushion pressure that the second cushion component 14 does not contract in bend-forming of the vertical wall portions 1Ba, 1Bb in a first process.

Herein, the cushion component is a device provided with a pressure maintaining function to generate reaction force against a formed article by hydraulic pressure, pneumatic pressure, or the like. The reaction force generated by the cushion component serves as the cushion pressure.

Next, a specific example of the press forming device of this embodiment is described with reference to FIG. 3.

The press forming device of this embodiment is provided with an upper die 10 and a lower die 20 as illustrated in FIG. 3.

The upper die 10 is provided with the pad 11 and the bending blades 12. The pad 11 is attached to the undersurface of a press sheet 13 for upper die through a third cushion component 15. In the third cushion component 15, the axis in the expanding and contracting direction is set in the press direction (vertical direction in FIG. 3). The third cushion component 15 is formed by a gas spring, for example. The cushion pressure thereof is set to 8 ton, for example.

The bending blades 12 are disposed on the sides of the pad 11 and used for bend-forming the vertical wall portions 1Ba, 1Bb. The bending blades 12 each are divided into the upper die component 12A and the lower die component 12B by a plane crossing the press direction at arbitrary positions among positions facing the vertical wall portions 1Ba, 1Bb. The upper die components 12A have shoulder portions 12Aa having upper end portions fixed to the press sheet 13 for upper die and bend-forming connection portions of the top sheet portion 1A and the vertical wall portions 1Ba, 1Bb.

The interval D between the upper die component 12A and the lower die component 12B is set to the interval D equal to or larger than the preset compression amount. The interval D is maintained by the second cushion component 14 interposed between the upper die component 12A and the lower die component 12B. The interval D may be set to a size of several millimeters which is less than 10 mm. By setting the interval D to be equal to or larger than the assumed compression amount, a plurality of compression amounts can be simply dealt with.

The second cushion component 14 is formed by a gas spring, for example, and is contractible when pressure equal to or higher than the preset predetermined pressure is applied in a direction along the press direction. For example, when the predetermined pressure described above is applied, the second cushion component 14 begins to contract. The interval D decreases by the amount corresponding to the magnitude of the applied pressure. The second cushion component 14 is provided so as to be contractible until the upper die component 12A and the lower die component 12B abut on each other, i.e., the interval D becomes zero. The cushion pressure of the second cushion component 14 is set to 3 ton, for example.

The lower die 20 is provided with the punch 21 and the stoppers 22 disposed on the sides of the punch 21.

The punch 21 is set to face the pad 11 in the press direction and provided through the first cushion component 24 with respect to the upper surface of a press sheet 23 for lower die. The first cushion component 24 is formed by a die cushion, such as a cushion pin, for example, and is elastically expandable and contractible in the press direction. The cushion pressure of the first cushion component 24 is set to 50 ton, for example.

The stoppers 22 are fixed to the upper surface of the press sheet 23 for lower die. The gap between the punch 21 and the stoppers 22 is set to be less than the thickness of the material to be processed 2, e.g., 0.02 mm or less, as viewed in the press direction.

Herein, the cushion pressure of each of the first cushion component 24, the second cushion component 14, and the third cushion component 15 is set to satisfy the following relationship.

First cushion component 24>Third cushion component 15

Third cushion component 15>Second cushion component 14

However, the cushion pressure of the second cushion component 14 is set to be equal to or higher than such cushion pressure that the interval D between the upper die component 12A and the lower die component 12B does not vary, i.e., the cushion component does not contract, in a state where the vertical wall portions 1Ba, 1Bb are bend-formed and compressive force in a direction along the press direction is not applied to the vertical wall portions 1Ba, 1Bb.

By setting the relationship of "Cushion pressure of first cushion component 24>Cushion pressure of third cushion component 15", the punch 21 placed on the first cushion component 24 can be set so as not to move up and down when bend-forming is advanced by the bending blades 12 while pressing the top sheet portion 1A with the pad 11.

When the cushion pressure (pressure) of the second cushion component 14 is set to 3 ton or more, the interval D between the upper die component 12A and the lower die component 12B can be maintained constant in bend-forming the vertical wall portions 1Ba, 1Bb.

Moreover, by setting the relationship of "Cushion pressure of first cushion component 24>Cushion pressure of second cushion component 14", a desired compression amount can be applied to the vertical wall portions 1Ba, 1Bb by lowering the upper die 10 in a second process.

<Method for Producing Press-Formed Article 1>

Next, a method for producing the press-formed article 1 using the above-described press forming device is described.

The method for producing the press-formed article 1 of this embodiment has at least the first process and the second process performed following the first process.

The first process includes bend-forming the vertical wall portions 1Ba, 1Bb of a base sheet or the material to be processed 2 (blank) obtained by applying bending or drawing to a base sheet beforehand into a hat cross-sectional shape having the top sheet portion 1A and the right and left vertical wall portions 1Ba, 1Bb continuous to both sides in the width direction of the top sheet portion 1A and not having a flange portion to achieve a first formed state. More specifically, the first process is a process of forming the vertical wall portions 1Ba, 1Bb by setting the material to be processed 2 (blank) in the die, and then sandwiching the top sheet portion 1A of the material to be processed 2 with the punch 21 and the pad 11 and lowering the lower bending blades (lower die components 12B) of the divided bending blades 12 until the undersurfaces of the lower bending blades contact the stoppers 22.

The second process includes applying compression to the vertical wall portions 1Ba, 1Bb by the preset compression amount in a direction along the press direction in the bend-formed state by the first process to achieve a second formed state. More specifically, the second process is a process in which the upper die 10 is further lowered while maintaining the state where the entire component is sandwiched with the pad 11, the bending blades 12, and the punch 21 after the first formed state by the first process, and then the punch 21 placed on the first cushion component 24 is lowered accompanying the lowering. At this time, the upper die 10 is lowered until the second cushion components 14 (gas spring) set in the divided bending blades 12 contract, so that the interval D of the divided bending blades 12 decreases by the preset compression amount. Moreover, end portions (lower end portions of the vertical wall portions 1Ba, 1Bb) of the material to be processed 2 are constrained by being perpendicularly pressed against the surfaces of the stoppers 22 and do not move.

An operation of the die in the press-forming is described with reference to FIGS. 4A to 4E.

FIGS. 4A to 4E illustrate an example when a blank (material to be processed 2) deformed by springback after formed once by press-forming, such as foam or draw forming, is press-formed based on embodiments of the present invention to be produced as the press-formed article 1. It is a matter of course that a plate-like base sheet may be used as the blank (material to be processed 2).

Figure 4A:
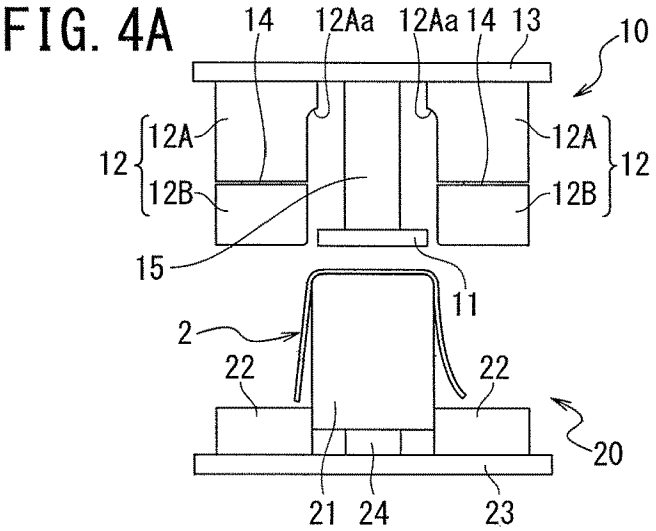
FIGS. 4A to 4E are cross-sectional views schematically explaining the movement of the die in press-forming according to the embodiment based on the present invention.

First, the top sheet portion 1A of the blank is placed on the punch bottom as illustrated in FIG. 4A. At this time, the punch 21 is raised by about 10 mm, for example, beforehand so that the punch bottom is higher than the vertical wall height of a component to be formed.

Figure 4B:
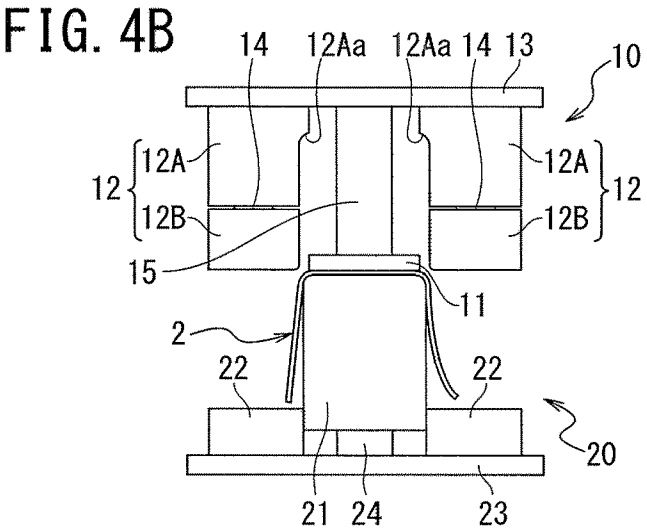
Figure 4C:
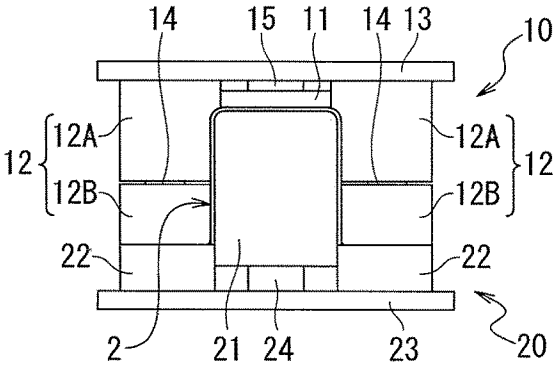

Next, the upper die 10 is lowered, whereby the top sheet portion 1A of the blank 2 is sandwiched with the punch 21 and the pad 11 as illustrated in FIG. 4B. Subsequently, the bend-forming of the vertical wall portions 1Ba, 1Bb by the bending blades 12 is performed by lowering the bending blades 12 as illustrated in FIG. 4C. Then, the undersurfaces of the lower bending blades (lower die components 12B) of the divided bending blades 12 are brought into contact with the stoppers 22. The operation of the die is set so that, when the undersurfaces of the lower die components 12B contact the stoppers 22, blank end portions contact the stoppers 22. The operation of the die is set so that, until the state above, the second cushion components 14 set in the divided bending blades 12 do not contract. This setting can be performed by the cushion pressure of the second cushion components 14. More specifically, the cushion pressure may be set to be higher than force transmitted to the lower bending blades (lower die components 12B) by friction from the vertical wall portions of the blank 2.

In this state (see FIG. 4C), the blank 2 is in the state of being sandwiched with the upper die 10 and the lower die 20, and thus is temporarily formed into a target component shape. This state is the first formed state. The above corresponds to the first process.

Figure 4D:
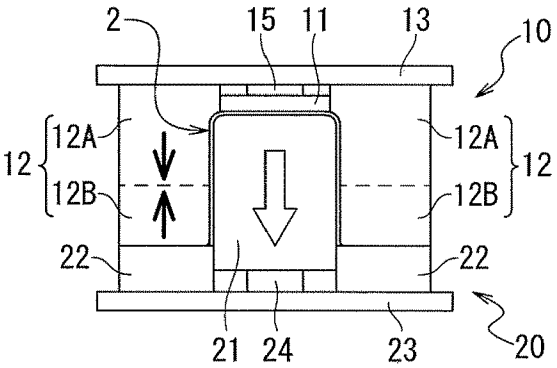

Next, after the first formed state, the upper die 10 is further lowered by the preset compression amount as illustrated in FIG. 4D. At this time, the lower die component 12B and the upper die component 12A approach by the contraction of the second cushion component 14, so that the interval D becomes small. More specifically, the pad 11 and the upper die components 12A of the bending blades 12 are lowered interlocking with the lowering of a slide of a pressing machine. The pressurization force of the pressing machine is higher than the cushion pressure interlocking with the punch 21, and therefore the punch 21 is also lowered. Meanwhile, the stoppers 22 are fixed and do not move, and therefore end portions of the blank 2 are constrained by the stoppers 22. Furthermore, the entire blank 2 is constrained by the pad 11, the bending blades 12, and the punch 21 at this time, and therefore there is no room for the blank 2 to cause out-of-plane deformation. Therefore, compressive force can be applied without causing buckling in the vertical wall portions 1Ba, 1Bb of the blank 2. This state is the second formed state (see FIG. 4D). The above corresponds to the second process.

Figure 4E:
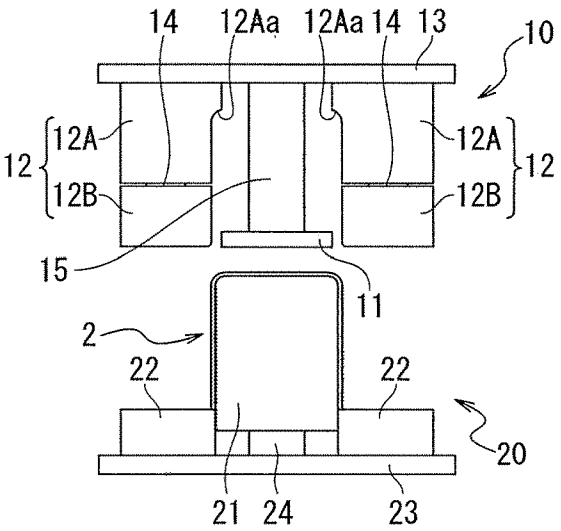

Finally, the upper die 10 is raised as illustrated in FIG. 4E to thereby release the press-formed article 1 produced by the press-forming from the die.

As described above, this embodiment can form the blank (material to be processed 2) into a component of a hat shaped cross section not having a flange portion, apply target compressive force to the vertical wall portions 1Ba, 1Bb, and reduce the warping of the vertical wall portions 1Ba, 1Bb occurring in performing the press-forming into the component shape having the top sheet portion 1A and the vertical wall portions 1Ba, 1Bb continuous thereto and not having a flange portion only by adjusting the lowering amount of the upper die 10. As a result, the press-formed article 1 with good dimensional accuracy can be provided.

EXAMPLES

Next, Examples based on embodiments of the present invention are described.

A 440 MPa grade cold-rolled steel sheet (sheet thickness of 1.0 mm) and a 1180 MPa grade cold-rolled steel sheet (sheet thickness of 1.0 mm) as base sheets were press-formed into the press-formed article 1 of the hat cross-sectional shape having the top sheet portion 1A, the linear vertical wall portion 1Bb, and the curved vertical wall portion 1Ba and not having a flange portion as illustrated in FIGS. 2A and 2B.

Figure 5:
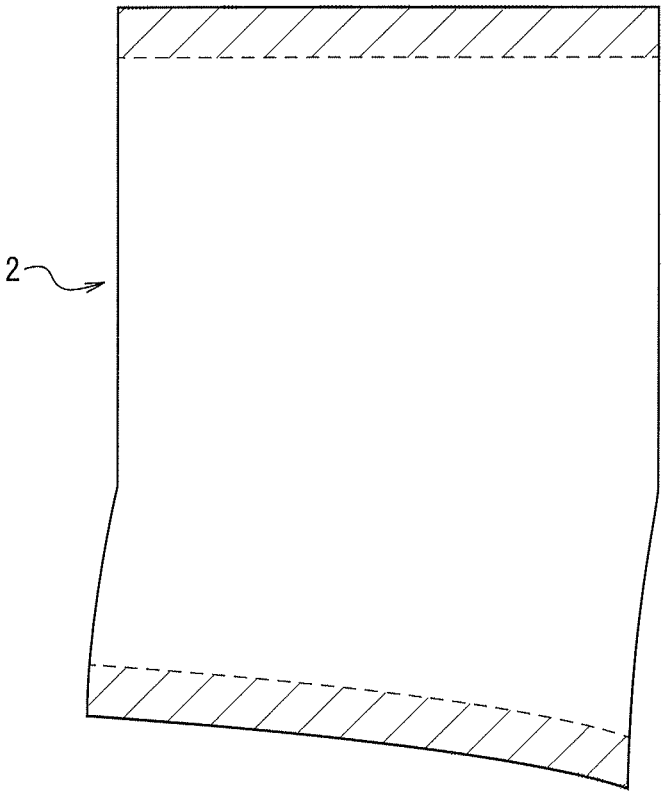
FIG. 5 is a figure schematically illustrating a developed state of a blank used in Examples.

At this time, in order to vary the compression amount to the vertical wall portions 1Ba, 1Bb of the press-formed article 1, blanks in which the blank shapes were individually adjusted so that the blank lengths of the vertical wall portions 1Ba, 1Bb were longer by 1 to 5 mm than the heights of the vertical wall portions 1Ba, 1Bb of a formed article as in the developed blank shape illustrated in FIG. 5 were prepared as the material to be processed 2. Hatched portions in FIG. 5 are lengthened portions.

Then, each blank above was subjected to usual processing of performing foam forming in a state where the top sheet portion 1A was sandwiched with the pad 11 beforehand, and then sprung back by forming release to create a blank (material to be processed 2). Then, the blank was press-formed using the die described in the embodiment.

The compression amount to be set corresponds to the length made larger than the heights of the vertical wall portions 1Ba, 1Bb of the formed article. More specifically, the compression amount was set in the range of 1 to 5 mm. The compression amount can be adjusted by the lowering amount of the upper die 10.

The heights of the vertical wall portions 1Ba, 1Bb in the product shape were set to 83 mm as illustrated in FIG. 2A.

Figure 6A:
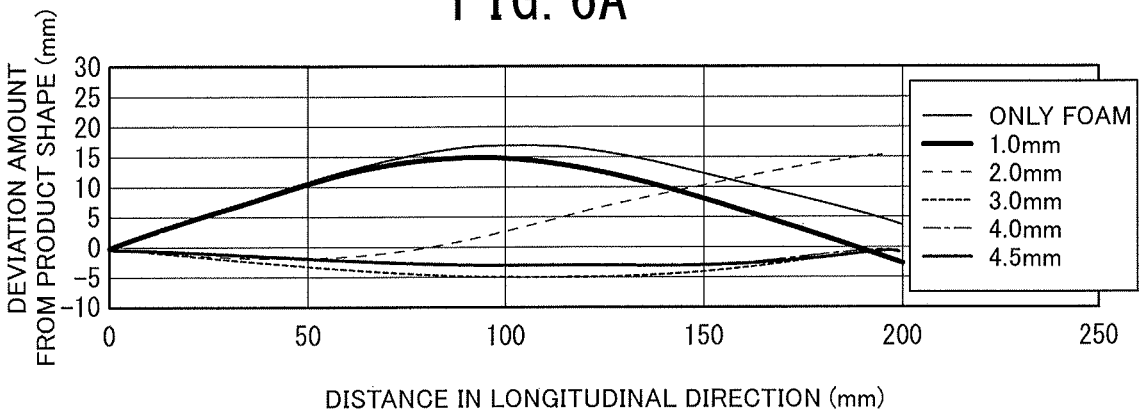
FIGS. 6A and 6B are figures illustrating results of measuring the deviation amount from the component shape in the evaluation cross sections of components produced by the press-forming in the longitudinal direction.
Figure 6B:
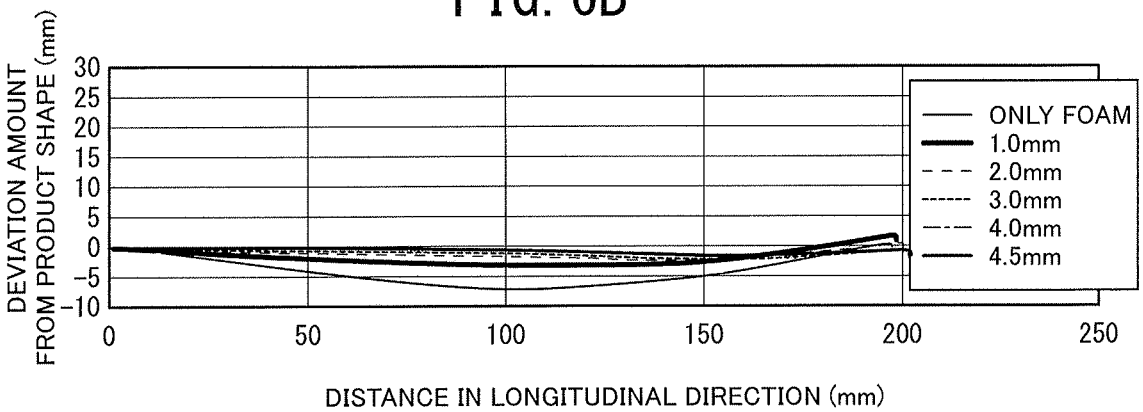

Then, the deviation degree of the cross-sectional shape when each compression ratio was applied from the component shape as a product after the press-forming was measured along the longitudinal direction. FIGS. 6A and 6B illustrate the measurement results in each material. In FIGS. 6A and 6B, "only foam" (corresponding to No. 1 and No. 8 of Table 1) indicates a case where the application of the compression by the second process was not performed. FIG. 6A illustrates a case where the material is the 1180 MPa grade cold-rolled steel sheet. FIG. 6B illustrates a case where the material is the 440 MPa grade cold-rolled steel sheet.

Table 1 illustrates the amount in which the vertical wall portion 1Ba was lengthened from the component shape and the compression ratio generated in the vertical wall portions 1Ba, 1Bb at this time. The amount obtained by subtracting the minimum value from the maximum value of the deviation amount from the product shape along the longitudinal direction is defined as the waving amount. In the evaluation of this Example, a case where the waving amount was 5 mm or less was determined that the shape fixability was excellent, which was expressed by "○" in Table 1. Some actual products are passed even when the waving amount is 10 mm or less in some cases. Even when the waving amount determination was "x" in Table 1, some products are passed as a product in some cases. Herein, the compression ratio is a ratio of the compression amount to the height of the vertical wall portion 1Ba ((Compression amount/Height of vertical wall portion)×100) in the final product shape.

TABLE 1

| No. | Material | Blank extension amount (mm) | Compression ratio (%) | Method | Waving amount determination |
|---|---|---|---|---|---|
| 1 | 1180 MPa steel sheet | No extension | 0.0 | Conventional example | x |
| 2 | 1180 MPa steel sheet | 1.0 | 1.2 | Present invention example | x |
| 3 | 1180 MPa steel sheet | 2.0 | 2.4 | Present invention example | x |
| 4 | 1180 MPa steel sheet | 3.0 | 3.6 | Present invention example | x |
| 5 | 1180 MPa steel sheet | 4.0 | 4.8 | Present invention example | ○ |
| 6 | 1180 MPa steel sheet | 4.5 | 5.4 | Present invention example | ○ |
| 7 | 1180 MPa steel sheet | 5.0 | 6.0 | Present invention example | x (Buckling occurred) |
| 8 | 440 MPa steel sheet | No extension | 0.0 | Conventional example | x |
| 9 | 440 MPa steel sheet | 1.0 | 1.2 | Present invention example | x |
| 10 | 440 MPa steel sheet | 2.0 | 2.4 | Present invention example | ○ |
| 11 | 440 MPa steel sheet | 3.0 | 3.6 | Present invention example | ○ |
| 12 | 440 MPa steel sheet | 4.0 | 4.8 | Present invention example | ○ |
| 13 | 440 MPa steel sheet | 4.5 | 5.4 | Present invention example | ○ |
| 14 | 440 MPa steel sheet | 5.0 | 6.0 | Present invention example | x (Buckling occurred) |

As is understood from FIGS. 6A and 6B, it is found that the warping of the curved vertical wall portion 1Ba is improved with an increase in the compression ratio, so that the cross-sectional shape approaches the component shape. Furthermore, it is found that the deviation amount from the component shape of the cross section decreases accompanying the same.

Figure 7:
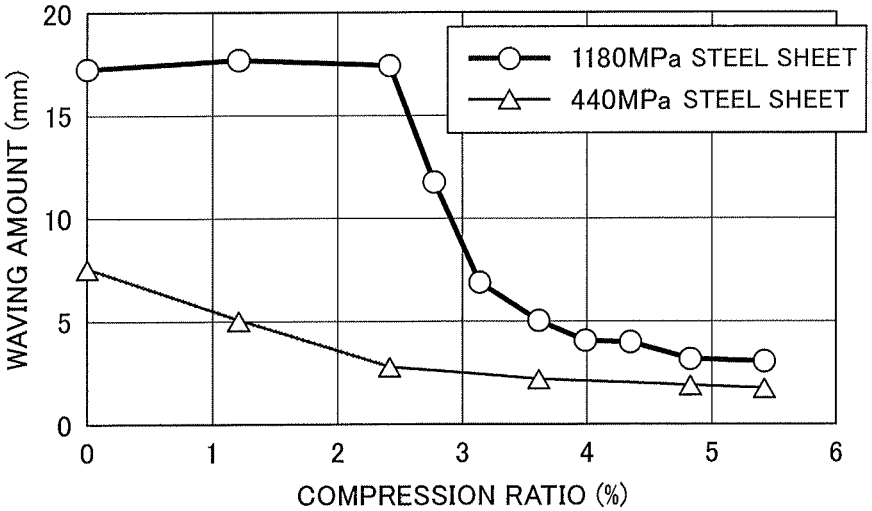
FIG. 7 is a figure illustrating the relationship between the waving amount and the compression ratio applied to the vertical wall portion on the curved side.

FIG. 7 illustrates the relationship between the compression ratio applied to the vertical wall portion 1Ba and the waving amount. As is understood from FIG. 7, it is found that, in the 1180 MPa steel sheet, the warping of the vertical wall portion 1Ba is sharply improved and the waving amount starts to decrease around when about 2.5% of the compression ratio was applied, i.e., 2.5% or more. The waving amount is less than 10 mm when the compression ratio is 3.0% or more and furthermore the waving amount is less than 5 mm when the compression ratio is 4.0% or more, which shows that the waving amount reduction effect starts to converge. Also in the 440 MPa steel sheet, the warping of the vertical wall portion 1Ba is similarly improved with an increase in the compression ratio. The waving amount was less than 5 mm at the compression ratio of 2.0% or more. Moreover, in this example, no material was able to be formed under the conditions where the compression ratio exceeded 6.0% because the material flowed into the gap between the divided bending blades 12 and buckling occurred. In view of the above, in the component shape using the 1180 MPa grade cold-rolled steel sheet, the compression ratio is preferably 3.0% or more and less than 6.0% and more preferably 4.0% or more and less than 6.0%. In the component shape using the 440 MPa grade cold-rolled steel sheet, the compression ratio is preferably 2.0% or more and less than 6.0%.

Figure 8:
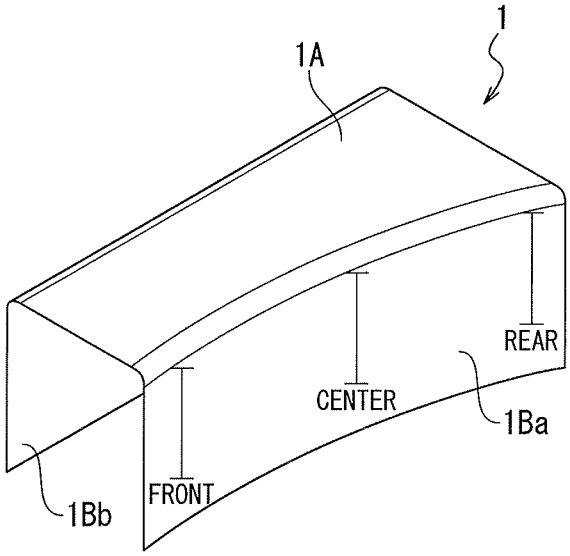
FIG. 8 is a figure illustrating evaluation positions.

Next, the buckling wrinkle height was acquired from the cross-sectional shape at a position 50 mm below the shoulder R stop of the punch 21 of the vertical wall portion 1Ba on the curved side at positions illustrated in FIG. 8 when the compression ratio applied to the vertical wall portion 1Ba is 4.8%, and then the relationship between the average value of the buckling wrinkle heights and the clearance between the upper and lower dies 10, 20 was determined. The results are illustrated in FIG. 9.

Figure 9:
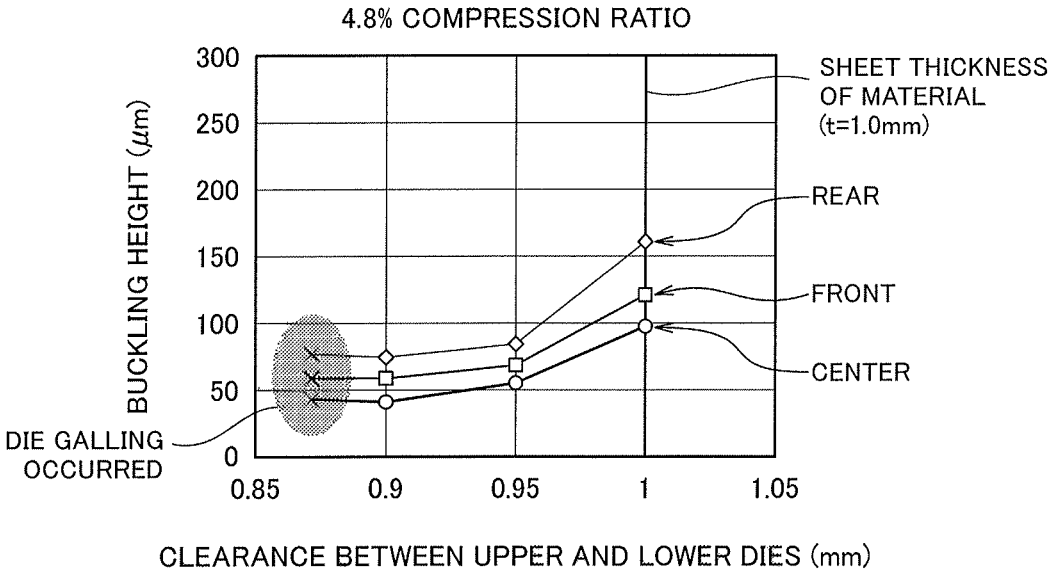
FIG. 9 is a figure illustrating the relationship between the buckling height and the clearance between upper and lower dies.

As is understood from FIG. 9, the buckling wrinkle heights of the vertical wall portions 1Ba on the curved side decrease as the clearance between the upper and lower dies 10, 20 is narrowed from the exact sheet thickness, so that a component having a good appearance shape was able to be obtained. When the clearance between the upper and lower dies 10, 20 is set to less than 90% of the sheet thickness of the material, the clearance was excessively narrow, and therefore galling occurred in the die. From the above, it is found that the clearance between the upper and lower dies 10, 20, i.e., the clearance between the side surface of the punch 21 and the bending blades 12 constraining the vertical wall portions 1Ba, 1Bb in applying the compressive force, is preferably 90% or more of the sheet thickness of the material and equal to or less than the sheet thickness and more preferably 90% or more and 95% or less of the sheet thickness.

Although the description is given referring to a limited number of embodiments herein, the scope of the present invention is not limited thereto. It is obvious for those skilled in the art to alter and modify the embodiments based on the disclosure above.

REFERENCE SIGNS LIST

1 press-formed article
1A top sheet portion
1Ba vertical wall portion on curved side
1Bb vertical wall portion
2 material to be processed
10 upper die
11 pad
12 bending blade
12A upper die component
12B lower die component
13 press sheet for upper die
14 second cushion component
15 third cushion component
20 lower die
21 punch
22 stopper
23 press sheet for lower die
24 first cushion component
D interval

The invention claimed is:

1. A press forming device for performing a first step of bend-forming a base sheet or a material to be processed obtained by applying bending or drawing to a base sheet beforehand into a pressed part shape having a top sheet portion and right and left vertical wall portions continuous to both sides in a width direction of the top sheet portion and not having a flange portion and a second step of applying compression by a preset compression amount in a direction along a press direction to the vertical wall portions in a formed state by the first step, the press forming device comprising:

a punch and a pad configured to sandwich the top sheet portion between the punch and the pad in a sheet thickness direction;

bending blades disposed on sides of the punch and the pad and configured to bend-form the vertical wall portions; and stoppers facing the bending blades in the press direction and configured to constrain end portions of the material to be processed, wherein the pad and the bending blades configure an upper die, the punch is supported by a first cushion component elastically expandable and contractible in the press direction, the bending blades each have an upper die component having a shoulder portion and a lower die component vertically divided in an arbitrary location below the shoulder portion of the upper die component and capable of facing the vertical portion of the vertical wall portion having the press part shape and by a face crossing with press direction and disposed facing each other in the press direction with an interval equal to or larger than the compression amount to be applied and a second cushion component interposed between the upper die component and the lower die component at the arbitrary location below the shoulder portion of the upper die component, configured to maintain the interval, and contractible in the press direction at a predetermined pressure or more, and cushion pressure of the second cushion component is lower than cushion pressure of the first cushion component and has such cushion pressure that the second cushion component does not contract during the bend-forming of the vertical wall portions in the first step.

2. A method for producing a press-formed article comprising:

a first step of forming a base sheet or a material to be processed obtained by applying bending or drawing to a base sheet beforehand into a pressed part shape having a top sheet portion and right and left vertical wall portions continuous to both sides in a width direction of the top sheet portion and not having a flange portion; and a second step of applying compression by a preset compression amount in a direction along a press direction to the vertical wall portions in a formed state by the first step, wherein, the first step and the second step include using a die which is provided with a punch and a pad sandwiching the top sheet portion between the punch and the pad in a sheet thickness direction, bending blades disposed on sides of the punch and the pad and bend-forming the vertical wall portions, and stoppers facing the bending blades in the press direction and constraining end portions of the material to be processed and in which the pad and the bending blades configure an upper die and the bending blades each have an upper die component having a shoulder portion and a lower die component vertically divided in an arbitrary location below the shoulder portion of the upper die component and capable of facing the vertical portion of the vertical wall portion having the press part shape and by a face crossing with press direction and disposed facing each other in the press direction with an interval equal to or larger than the compression amount to be applied and a cushion component interposed between the upper die component and the lower die component at the arbitrary location below the shoulder portion of the upper die component, maintaining the interval, and contractible in the press direction at a predetermined pressure or more, in the first step, the vertical wall portions are bend-formed by moving the bending blades in the press direction while maintaining a state where the cushion component does not contract by cushion pressure until the end portions of the material to be processed abut on the stoppers and the lower die components abut on the stoppers while sandwiching the top sheet portion with the punch and the pad, and in the second step, the bending blades are further moved in the press direction by the preset compression amount following the first step, so that the vertical wall portions are sandwiched between the bending blades and a side surface of the punch, whereby the interval becomes small while preventing buckling, so that the compression is applied to the vertical wall portions.

3. The method for producing a press-formed article according to claim 2, wherein the material to be processed is a metal sheet having tensile strength of 440 MPa or more.

* * * * *